US005248136A

United States Patent [19]

Hamanaka

[11] Patent Number: 5,248,136

[45] Date of Patent: Sep. 28, 1993

[54] SORTING APPARATUS WITH TWO SORTERS

[75] Inventor: Izumi Hamanaka, Hachioji, Japan

[73] Assignee: Konica Corporation, Tokyo, Japan

[21] Appl. No.: 929,912

[22] Filed: Aug. 17, 1992

[30] Foreign Application Priority Data

Aug. 21, 1991 [JP] Japan ..... 3-209529
May 26, 1992 [JP] Japan ..... 4-133706

[51] Int. Cl.[5] ..... B65H 39/02; B65H 39/10

[52] U.S. Cl. ..... 270/58; 271/290

[58] Field of Search ..... 270/58; 271/290, 289

[56] References Cited

U.S. PATENT DOCUMENTS 3,395,913 8/1968 Del Vecchio et al. ..... 270/58 X
3,484,101 12/1969 Cassano ..... 270/58 X
3,618,936 11/1971 Ziehm ..... 271/290 X
3,709,480 1/1973 Schulze et al. ..... 270/58 X
3,750,880 8/1973 Petrovsky et al. ..... 270/58 X
4,361,320 11/1982 Kikuchi et al. ..... 271/290 X
4,711,444 12/1987 Geurts ..... 271/290
5,013,027 5/1991 Furukawa ..... 271/290
5,177,546 1/1993 Tsubo ..... 270/58 X

FOREIGN PATENT DOCUMENTS 222967 9/1987 Japan ..... 270/58
1436600 5/1976 United Kingdom ..... 271/290

*Primary Examiner*—Edward K. Look
*Assistant Examiner*—John Ryznic
*Attorney, Agent, or Firm*—Finnegan, Henderson, Farabow, Garrett & Dunner

[57] ABSTRACT

A sorting apparatus of linkage type, which sorts a plurality of recorded sheets which are ejected from an image forming apparatus. The apparatus has at least two sorters, a plurality of bins and a stapling unit in each sorter respectively to store a stack of recorded sheets sorted as a copy set and to staple each stack of recorded sheets and guide means to guide each recorded sheet to a bin of a sorter allocated by controlling means. The controlling means selects at least two sorters for making the copy sets larger in number then a predetermined number. The second sorter receives sheets even though some trays of the first sorter are left unused.

6 Claims, 7 Drawing Sheets

SORTING APPARATUS WITH TWO SORTERS

BACKGROUND OF THE INVENTION

The present invention relates to a sorter that is attached to an image forming apparatus such as a copying machine, a printing machine or a laser beam printer and receives in each bin multiple copy sheets ejected from the image forming apparatus after sorting and grouping them, and more particularly, to a sorter with stationary bins wherein a plurality of sorters can be linked.

A type of a sorter sorting and grouping automatically a plurality of sheets (copy sheets) ejected from an image forming apparatus such as a copying machine includes a type of stationary bins, a type of all movable bins and type of each opening and moving bin.

In the case of a type of stationary bins, when making multiple sets of recorded sheets from multiple originals in an image forming apparatus, sheets ejected from the image forming apparatus are taken successively in a sheet-receiving portion of the sorter, then moved to the transport portion, and taken into each bin to be bound in a proper sequence by the action of a branch guide (a ranch gate) provided at a sheet-inlet of each bin on an allocating unit composed of multiple bins, on a half way of transport, thus recorded sheets of multiple sets corresponding to the maximum number of bins are arranged methodically.

The sorters of a type of stationary bins are widely used for high speed copying machines of a console type because of advantages that the number of sheets to be taken in bins is relatively large, responding speed is high and a plurality of sorters can be linked. For example, each of 20 bins for sorting or grouping can take in about 50 sheets for stacking.

On the other hand, a sheet finisher provided with a stapler unit that staplers sheets ejected from a copying machine or the like includes;

(1) a sheet finisher that is used in combination with a device such as an automatic original-transport unit of a circulating type (RDH) and staples each group of sheets, (2) a device wherein a stapler unit is provided on a relatively simple sorter of a type of movable bins {Japanese Patent Publication Open to Public Inspection No. 43457/1989 (hereinafter referred to as Japanese Patent O.P.I. Publication)}, which is a sorter in which a stapler unit stapling sheets in each bin is arranged to be movable back and forth against the bin, (3) a sheet finisher wherein a stationary stapler unit is provided on each bin and each bin is moved to the stapling position for stapling a bundle of sheets, and (4) a sheet finisher of a sorter disclosed in Japanese Patent O.P.I. Publication No. 244869/1987 wherein a bin holding thereon sheets is moved for stapling to the position capable of stapling, and stapling for other bins requires bin movement and vertical movement of a stapler unit.

A sheet ejected from the image forming apparatus mentioned above and received by the above-mentioned sorter of a type of stationary bins is transported at high speed through the horizontal path and the vertical path both in the sorter into each bin mentioned above or onto a non-sort tray.

A plurality of bins in the sorter mentioned above are generally composed of the maximum of 20 bins. When sorting sheaves of sheets in quantity of 20 or more in bins, therefore, a plurality of sorters need to be linked together so that sheets ejected from an image forming apparatus may be sorted and received successively in each bin of the sorters.

In conventional sorters of a multiple linkage type, they have been used so that the bins of the first sorter may follow the bins of the second sorter. Namely, when sorting 21 sets of recorded sheets on sorters each consisting of 20 bins, 21st set of recorded sheets is received by the uppermost bin of the second sorter only after one through 20 sets of recorded sheets have been received by 20 bins of the first sorter in succession downward from the top bin.

In the case of a sorter provided with a stapler unit, stapling for recorded sheets in each bin is conducted downward only after all recorded sheets in predetermined quantity in each bin have been received by the bin. Therefore, it takes a long time to finish stapling, resulting in a long down time and poor productivity for the total operation.

Now, it is assumed that $t_1$ represents a copying interval, $t_2$ represents a stapling interval, and stapling for the first bin is started after a copy sheet has been ejected into the first bin. Incidentally, the relation of $t_2 > t_1$ is generally normal.

In the second sorter, stapling for the 21st set of recorded sheets is started after copy sheets have been ejected into the 21st bin, similarly to the above.

Under the assumption that $L_1$ represents a distance from an image forming apparatus to the first bin, $L_2$ represents a distance from the image forming apparatus to the 21st bin, V represents a sheet transport speed and $N_1$ represents the number of sets of copy sheets which is 20 or less, time T required to cover the finish of copy operation in an image forming apparatus through the finish of stapling is as follows.

$$T_1 = L_1/V + t_2 \times N_1 - t_1 \times (N_1 - 1) \quad (1)$$

When $N_2$ represents the number of sets of copy sheets which ranges from 20 sets to 40 sets, the time required for the first sorter is as follows.

$$T_2 = L_1/V + t_2 \times 30 - t_1(N_2 - 1) \quad (2)$$

The time required for the second sorter is as follows.

$$T_3 = L_2/V + t_2(N_2 - 20) - t_1(N_2 - 20) - t_1 \times (N_2 - 21) \quad (3)$$

In this case, time required T is represented by $T_2$ or $T_3$ whichever is greater.

It has been desired to shorten the aforementioned required time T for reducing the down time which makes it impossible to take out all sets of copy sheets for use because of unfinished stapling even after the finish of copying.

SUMMARY OF THE INVENTION

An object of the invention is to solve the problems mentioned above, and the object is achieved by a sorter of a linkage type equipped with a stapler unit of the invention that receives recorded sheets ejected from an image forming apparatus and allocates them into a plurality of bins for stapling them wherein when recorded sheets in the number of sets equal to or less than the total number of bins in the first sorter of the linkage type sorter are received, the stapler is controlled so that the recorded sheets may be allocated to the selected bins in the first and second sorters to be stacked thereon.

Further, the linkage type sorter equipped with a stapler unit of the invention is further characterized in that the recorded sheets are allocated to the selected bins in the first and second sorters to be stacked thereon even when recorded sheets in the number of sets exceeding the total number of bins in the first sorter of the above-mentioned linkage type sorter are received.

Furthermore, the linkage type sorter equipped with a stapler unit of the invention is characterized in that the stapler is controlled so that stapling in each sorter can be finished almost concurrently.

Still further, the linkage type sorter equipped with a stapling unit of the invention is characterized in that when recorded sheets are ejected to the above-mentioned sorters, the stapler is controlled so that at least a plurality of recorded sheets corresponding to the last original may be allocated one by one to each sorter mentioned above to be stacked thereon.

The linkage type sorter mentioned above is further characterized in that the stapler is controlled so that when the last recorded sheet stacked on the bin in one sorter among those other than the above-mentioned two sorters is being paginated and stapled, the last recorded sheet may be stacked on a bin of the other sorter.

DETAILED DESCRIPTION OF THE INVENTION

Figure 1:
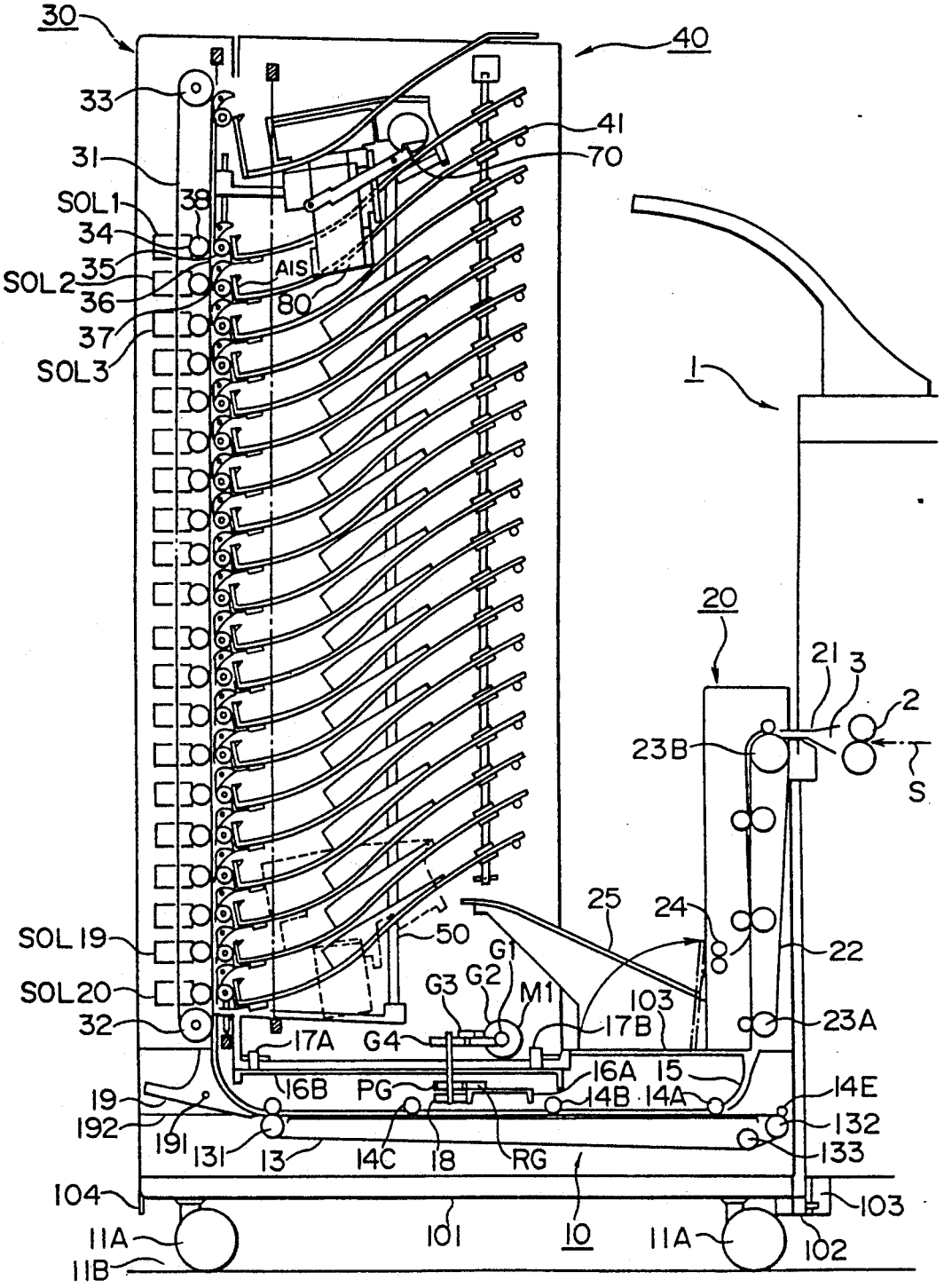
FIG. 1 is a structural diagram of a sorter provided with a stapling unit linked to the main body of an image forming apparatus.

Examples of the present invention will be explained as follows, referring to the drawings.

FIG. 1 represents a structural diagram of a sorter linked to main body 1 of an image forming apparatus such as a copying machine, for example. The sorter of the invention comprises pedestal 10, downward sheet-transport portion 20, upward sheet-transport portion 30 and bin-moving portion 40.

The pedestal 10 is connected to the image forming apparatus main body 1 through connecting means 102 and 103 and is installed on the floor through casters 11A and legs 11B. On the top of the pedestal 10, there are affixed the downward sheet-transport portion 20 and the upward sheet-transport portion 30, and the bin-moving portion 40 can move in the direction perpendicular to the drawing plane. The pedestal 10 is further provided with lower guide plate 12, transport rollers consisting of transport belt 13, driving roller 131, driven roller 132 and tension roller 133, a plurality of pressure rollers 14A, 14B, 14C and 14D, upper guide plate 15, sheet-transport driving means and a pin-moving means.

On the pedestal (mid-transport portion) 10 mentioned above, there is affixed stay member 16A in the direction perpendicular to the plane of FIG. 1. Rack gear RG is affixed on the top of the stay member 16A.

Inside a housing of the bin-moving portion 40, there are supported rotatively rolls 17A and 17B for moving the housing, and the rolls 17A and 17B slide on rail 16B of the pedestal 10 making the housing of the bin-moving portion 40 to move in the direction perpendicular to the plane of the drawing.

In the housing of the bin-moving portion 40, there is provided driving motor M1 which drives and rotates pinion gear PG through worm gear G1 and reduction gear train G2, G3 and G4. Since the pinion gear PG is engaged with the rack gear RG affixed on the stay member 16A, the housing of the bin-moving portion 40 is moved in the direction perpendicular to the plane of the drawing by the driving rotation of the motor M1. Incidentally, the numeral 18 represents a rotatable roll provided on a coaxial basis with the pinion gear PG, and the roll 18 rotates to guide, being in contact with the stay member 16A.

Next, the downward sheet-transport portion 20 is connected to sheet-ejection roller 2 and sheet-ejection outlet 3 of the image forming apparatus main body 1, and is affixed on base 101 of the pedestal 10. Inside a housing of the downward sheet-transport portion 20, there is provided transport belt 22 stretched rotatively between driving roller 23A and driven roller 23B, and thereby sheet S ejected from the image forming apparatus is guided by guide plate 21 to be transported downward to be finally fed into the horizontal transport path in the pedestal 10. In addition, branching from the transport path, there are provided transport means 24 and tray 25 both are used for ejecting the sheet preceding a jammed sheet in the image forming apparatus main body 1 when a jam takes place in ADF or a sorter.

In the upward sheet-transport portion 30, there is endless transport belt 31 with several strings spread between driving roller 32 located at the bottom of a supporting frame and driven roller 33 located at the upper position of the supporting frame. An internal surface of the transport belt 31 is in contact with a plurality of rotating rollers 34 corresponding to inlets of bins described later. A plurality of transport rollers 35 corresponding to the rollers 34 are in contact with an external surface of the transport belt 31 to be rotated.

Branch guides 36 are located on the half way of the transport rollers 35 and at the inlets of bins to swing. These branch guides 36 are swung by swinging lever 38 provided on the tip of a shaft of rotating shaft 37 and solenoids SOL1 through SOL20. Therefore, when the branch guide 36 is rotated clockwise, a clam portion of the bottom of the branch guide 36 engages with a sheet-transport path formed by the transport belt 31 and transport rollers 35 to prevent a sheet from moving upward vertically, thus the branch guide 36 normalizes the sheet-receiving attitude. When sheet S is fed into the normalized sheet-receiving attitude, the sheet is deflected along the internal curved surface of the branch guide 36 at almost right angles, and it is received by bin 41.

Namely, the sheet S (shown with dashed lines in the figure) transported into the upward sheet-transport portion 30 of a sorter at high speed goes up while it is guided between the transport belt 31 and transport rollers 35. Then the sheet is deflected to the right by the branch guide 36 swung clockwise by a solenoid, and passes through the upper portion of the vertical stopper wall 41S of the bin 41 to go up toward the right along a slant of the bin 41. After the trailing edge of the sheet S passes through the upper portion of the stopper wall 41S mentioned above, the sheet S changes its movement from rise to a fall and slides with its weight along the surface of the bin 41 down to the stopper wall 41S where the sheet S stops with its trailing edge hit by the stopper wall.

A sorter provided with a stapler unit is composed of binmoving portion 40 that moves a sheet ejected from image forming apparatus main body 1 with reference of the center line to the reference position on one side for positioning, truing unit 50 that causes sheaves of sheets in a plurality of bins 41 to hit the reference wall at one side for truing, a sheet-holding unit that presses a sheaf of sheets stacked on each bin, bin-moving unit 70 that moves each bin to the predetermined stapling position, motor-powered stapler unit 80 that pushes a staple in, and an elevating unit that moves upward and downward both bin-moving unit 70 and stapler unit 80 together.

Figure 2:
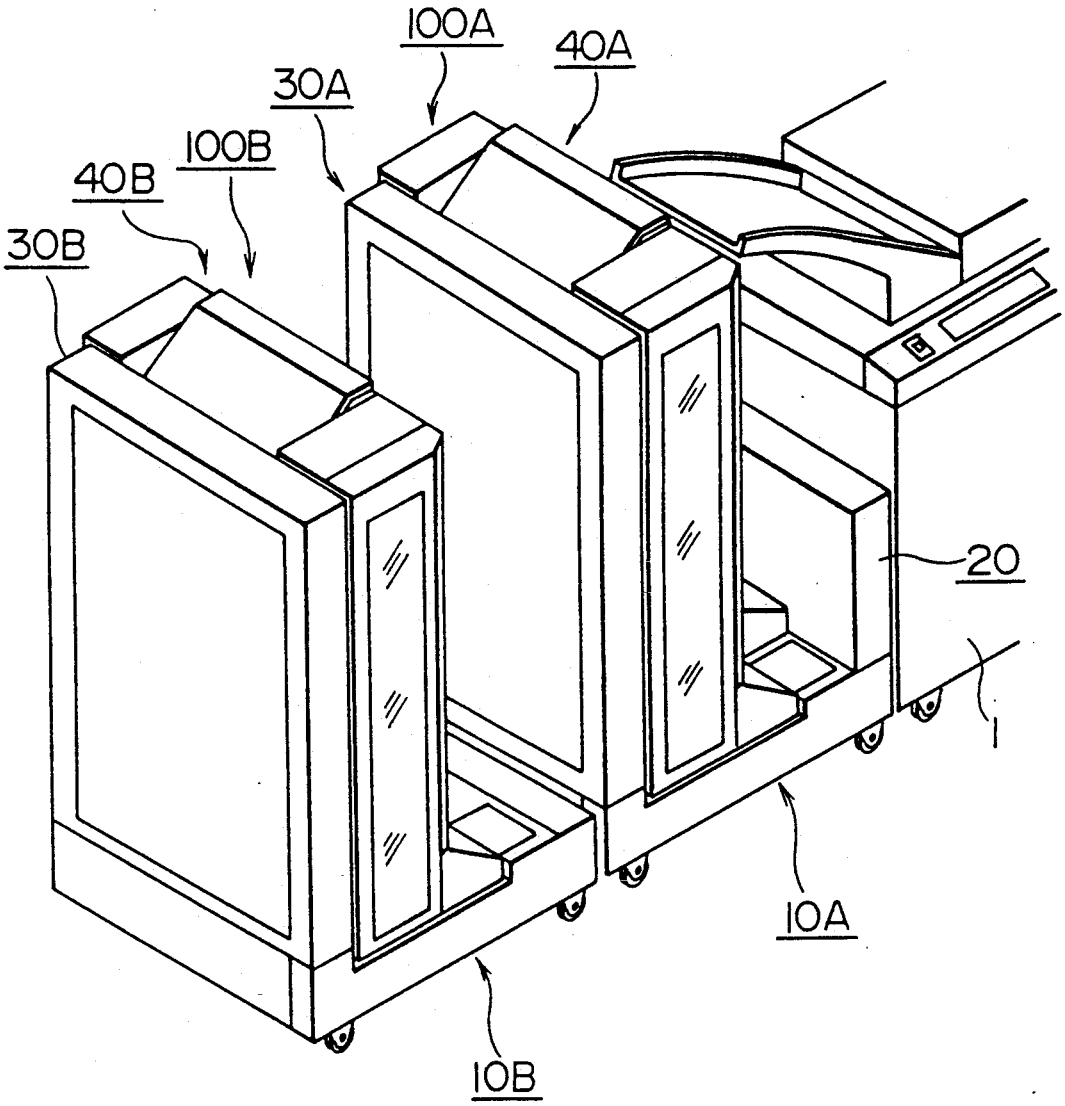
FIG. 2 is a perspective view showing how two sorters are linked to the image forming apparatus main body.
Figure 3:
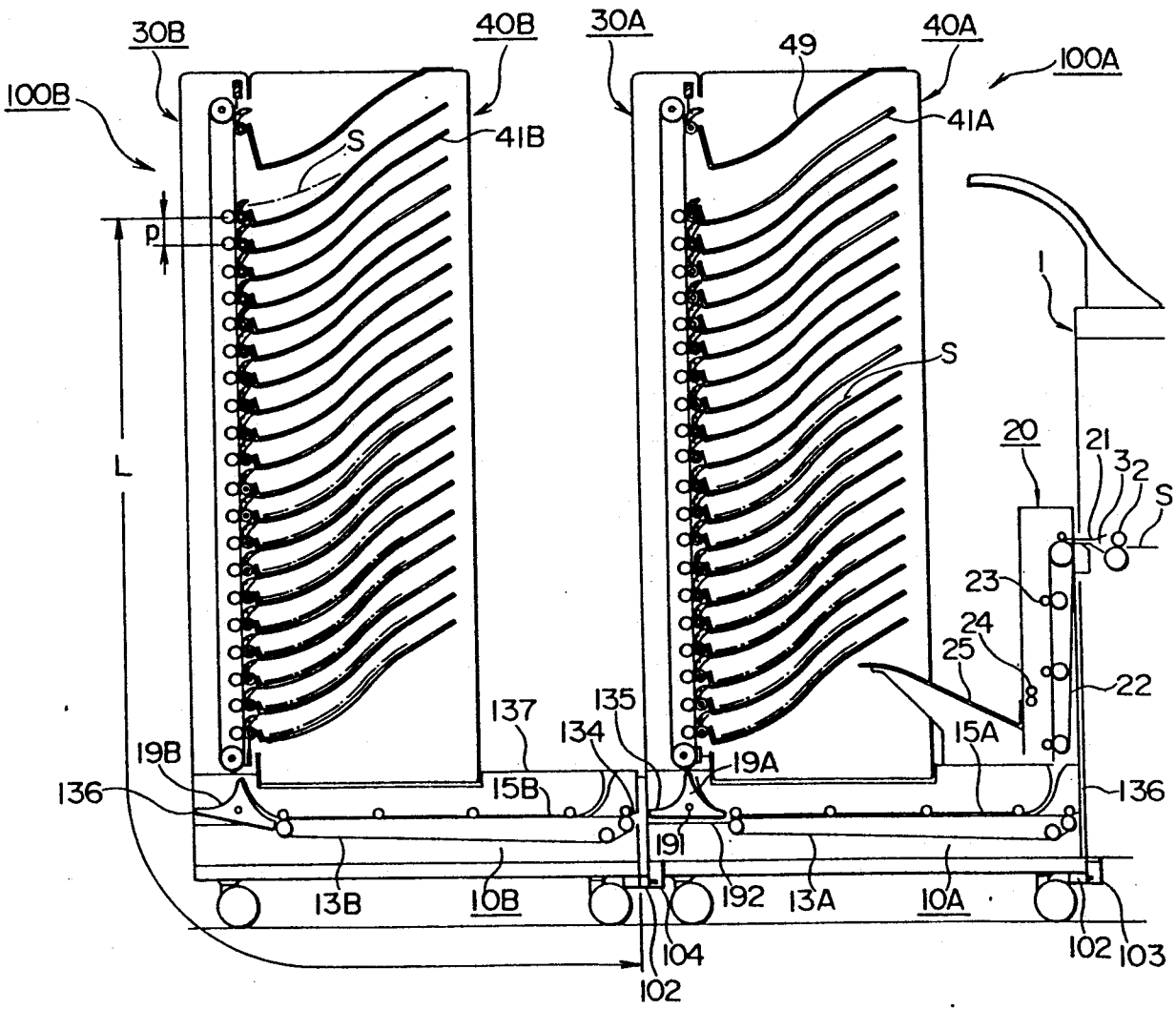
FIG. 3 is a front and sectional view of the above-mentioned two sorters linked.

FIG. 2 is a perspective view showing how two sorters are connected to the image forming apparatus main body and FIG. 3 is a front sectional view of the double-linked sorter.

The first sorter 100A to be connected to the sheet-ejection portion of the image forming apparatus main body 1 is composed of downward sheet-transport portion 20, horizontal transport portion 30A and bin-moving portion 40A. At two locations at the front and rear at the lower portion on the side of base 101 of the horizontal transport portion 10A facing the side of the image forming apparatus main body 1, there are affixed positioning pins 102 which are connecting means. The positioning pins 102 are detachably engaged with hole portions of connecting means 103 affixed on the lower part of the image forming apparatus main body 1, and they conduct vertical and horizontal positioning between a sheet-ejecting portion of the image forming apparatus and a sheet-receiving portion of the downward sheet-transport portion 20 of the sorter.

After positioning of both units mentioned, leveling of the first sorter 100A is conducted by means of leg 11B that can move upward and downward, and then the image forming apparatus main body 1 and pedestal 10A are affixed on an unillustrated plate for finishing installation of the first sorter 100A.

The second sorter 100B to be linked to the above-mentioned first sorter 100A is composed of horizontal transport portion 10B, upward sheet-transport portion 30B and bin-moving portion 40B, and it is common with the first sorter 100A in terms of structure except the downward sheet-transport portion 20.

Also at the lower position on the right side of the second sorter 100B, there is affixed positioning pin 102 of a connecting means identical to that in the first sorter 100A, and the positioning pin 102 is engaged with a hole portion of the connecting means 104 affixed at the lower position on the left side of the first sorter 100A for positioning.

At the downstream side in transport of transport belt 13A in the first sorter 100A, there is supported branch gate plate 19A so that it may swing freely with swinging shaft 191 as the center of swinging. The branch gate plate 19A is driven by an unillustrated solenoid (SOL) to swing, and it branches to an upward sheet-transport path leading to the aforementioned upward sheet-transport portion 30A and to a horizontal sheet-transport path leading to the second sorter 100B. The numeral 192 is a stationary lower guide plate and it forms sheet-ejecting path 135.

Incidentally, any of the aforementioned inlet portion 134 and the sheet-ejecting path 135 whichever is not used as an opening is closed with shielding plates 136 and 137 to prevent foreign materials from entering.

The aforementioned branch gate plate 19A is normally located at a position shown with solid lines, and it leads upward the sheet S which has been transported by transport belt 13A along upper guide plate 15A so that the sheet S may be received in bin 41A of the first sorter 100A.

After the sheet S is received in the predetermined bin 41A of the first sorter 100A mentioned above, the branch gate plate 19 mentioned above is swung by the solenoid to the position shown in FIG. 3 and thereby the aforementioned upward sheet-transport path is closed and the horizontal sheet-transport path is opened. Therefore, the sheet S transported by the transport belt 13A passes through a horizontal sheet-transport transport path formed by a bottom guide surface of the branch gate plate 19A and lower guide plate 192 to be transported to inlet portion 134 of horizontal sheet-transport portion 10B in the second sorter 100B. The sheet S further passes through the horizontal sheet-transport portion 10B and a sheet-transport path formed by the stationary branch gate plate 19B and upper guide plate 15B to go up, and received in bin 41B.

In the above-mentioned manner, each sheet S is received in each bin 41B of the second sorter 100B in succession, thus, sheaves of sheets in quantity of a maximum sets of 40 being twice as many as those in each sorter including bins 41A of the first sorter 100A can be grouped and received.

Figure 4:
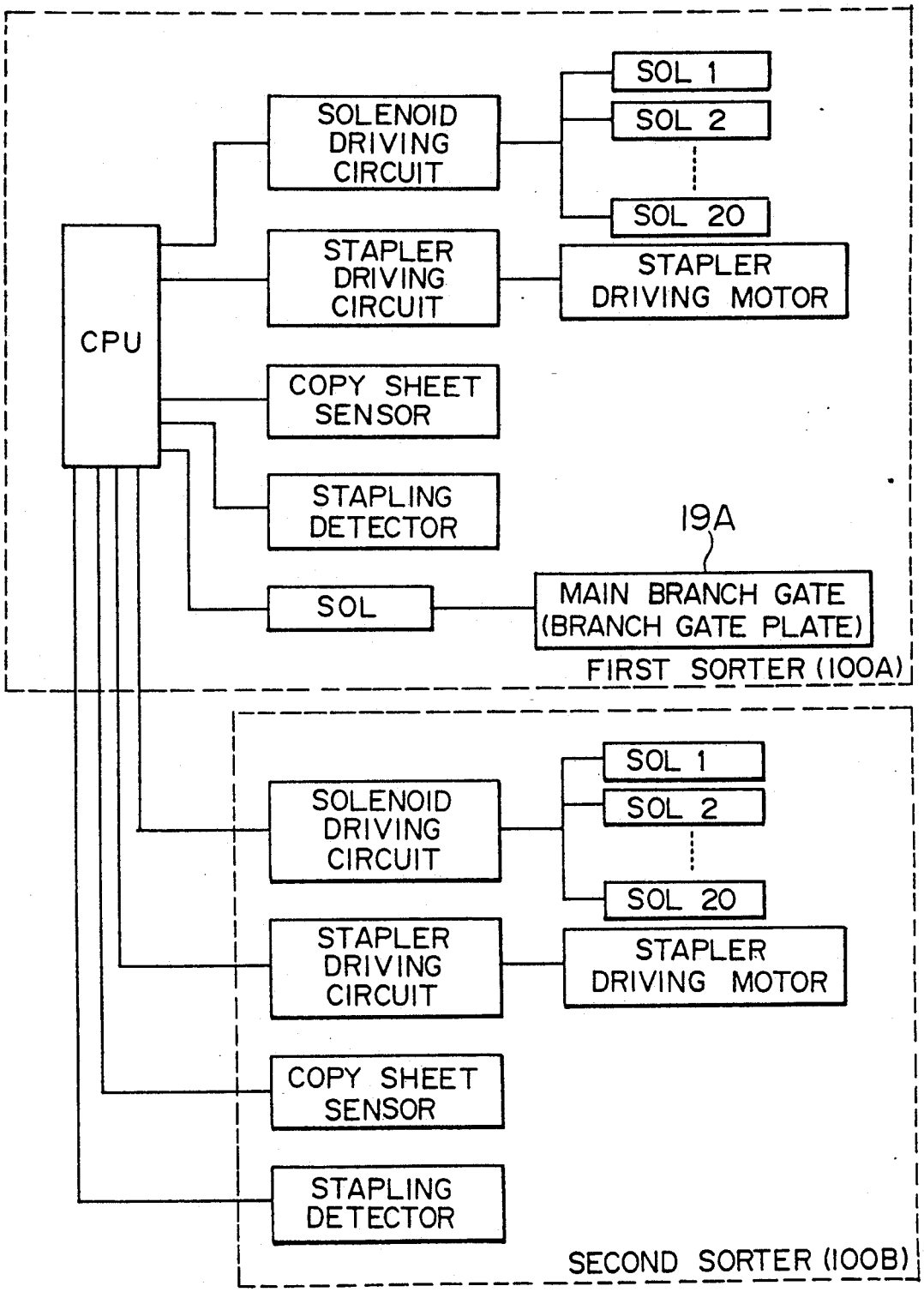
FIG. 4 is a block diagram of a double-linked sorter of the invention.
Figure 5:
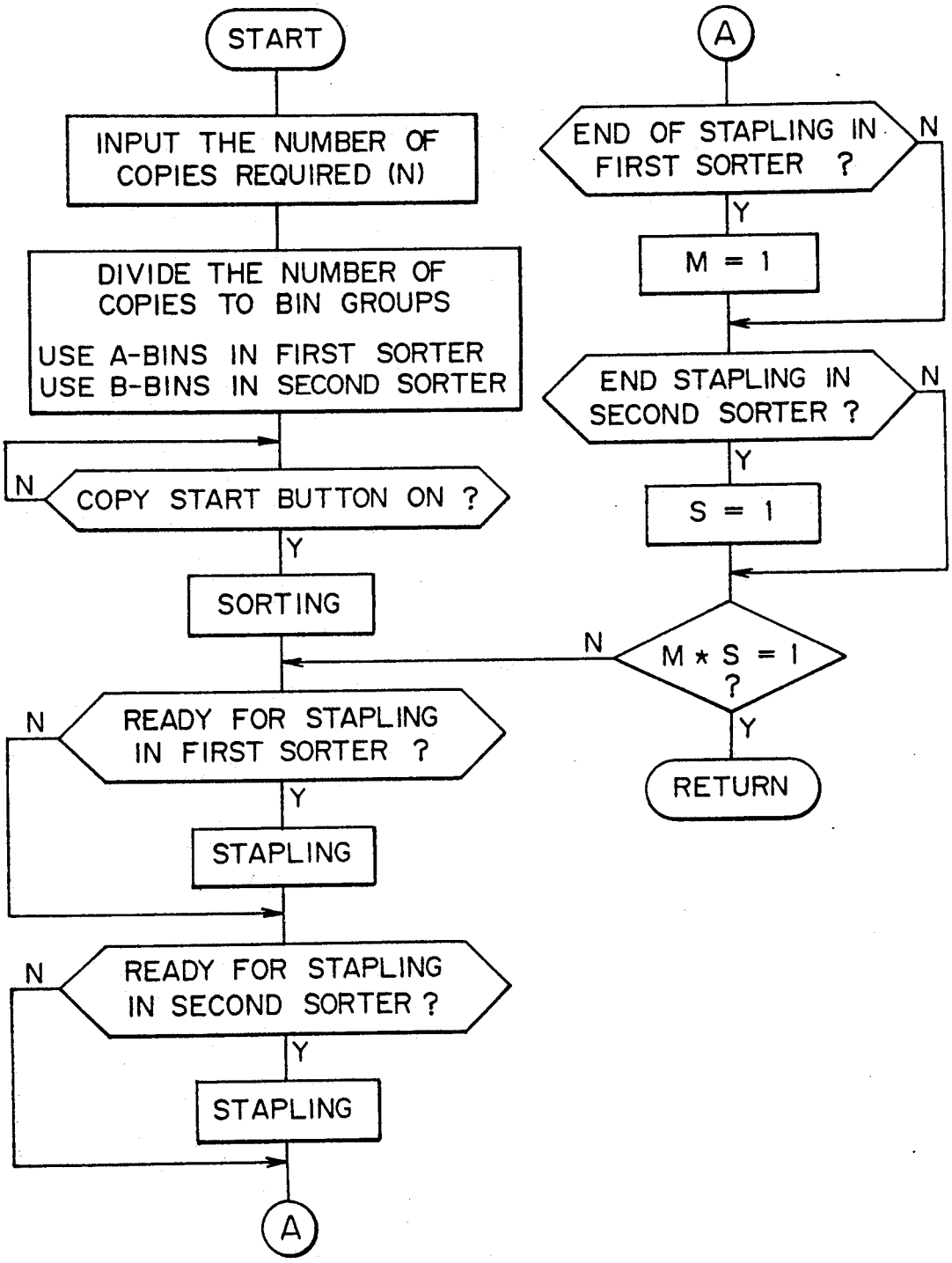
FIG. 5 is a flow chart for operations of the double-linked sorter of the invention.

FIG. 4 represents a block diagram of a double-linked sorter equipped with a stapler unit of the invention. FIG. 5 is a flowchart showing sorter allocation and stapling operations of the invention. "Ready for stapling" in this case means that a sheaf of sheets has been received in the first bin of a sorter but the sheaf of sheets has not been stapled yet. Further, "A-BINS" in this case means the specified number of bins in the first sorter and "B-BINS" means the specified number of bins in the second sorter.

Action time of a sorter provided with a stapler unit of the invention will be discussed next.

Under the assumption that $N_1$ represents the number of bins used in the first sorter, $N_2$ represents that in the second sorter (total number of bins used $N_T=N_1+N_2$), and $T_A$ represents the time required for covering a period from ejection of the last sheet from an image forming apparatus to the end of stapling in the first sorter, $T_A$ is shown by the following expression;

$$T_A 32\ L_1/V+t_2\times N_1-t_1\times(N_1+N_2-1) \quad (4)$$

wherein, $t_1$ is a time interval of copying, $t_2$ is a time interval of stapling, V is a linear speed of sheet transport and $L_1$ is a distance between an outlet of an image forming apparatus and the first bin.

Similarly to the above, $T_B$ that is the time required for covering up to the end of stapling in the second sorter is shown by the following expression;

$$T_B=L_2/V+t_2\times N_2-t_1\times(N_2-1) \quad (5)$$

wherein, $L_2$ is a distance between an outlet of an image forming apparatus and the 21st bin.

The condition of $T_A=T_B$ gives the shortest operation time.

Due to $N_1+N_2=N_T$, when $(N_2=N_T-N_1)$ is substituted for $N_2$ in the above expressions, the following expressions are obtained.

$$T_A=L_1/V+t_2\times N_1-t_1\times(N_T-1) \quad (6)$$

$$T_B=L_2/V+t_2\times(N_T-N_1)-t_1\times(N_T-N_1-1) \quad (7)$$

In the above expressions, the shortest operation time can be obtained when both sorters are caused to finish their operations concurrently by setting the time required for the first sorter and that for the second sorter to be the same ($T_A=T_B$). Therefore, when the above expressions (6) and (7) are caused to be the same, the following expression (8) can be obtained.

$$N_1=(-L_1/V+L_2/V+N_Tt_2)\ /\ (2t_2-t_1) \quad (8)$$

When the following values are substituted for items in expression (8), expression (9) is obtained.

$L_1=2000$ mm
$L_2=3000$ mm
$V=1000$ mm/sec
$t_1=1$ sec $$N_1=(1+2N_T)\ /\ 3 \quad (9)$$

The results of Table 1 can be obtained by substituting $N_T$ (=1–40) in expression (9). In the expression, $N_1'$ represents a value of rounded $N_1$ and $N_2'$ is $(N_T-N_1')$.

TABLE 1

| $N_T$ | $N_1$ | $N_1'$ | $N_2'(N_T-N_1')$ |
|---|---|---|---|
| 1 | 1 | 1 | 0 |
| 2 | 1.67 | 2 | 0 |
| 3 | 2.33 | 2 | 1 |
| 4 | 3.00 | 3 | 1 |
| 5 | 3.66 | 4 | 1 |
| : | | | |
| 20 | 13.6 | 14 | 6 |
| 21 | 14.3 | 14 | 7 |
| 22 | 15.0 | 15 | 7 |
| : | | | |
| 28 | 19.0 | 19 | 9 |
| 29 | 19.6 | 20 | 9 |
| : | | | |
| 39 | 26.3 | 20 | 19 |
| 40 | 26.7 | 20 | 20 |

For example, the time required for stapling the sheaves of sheets in quantity of 20 sets (N=20) in the conventional way is as follows (from expression (1)).

$$\begin{aligned} T_1 &= L_1/V + t_2 \times N_1 - t_1 \times (N_1 - 1) \\ &= 2000/1000 + 2 \times 20 - 1 \times (20 - 1) \\ &= 23 \text{ (sec)} \end{aligned}$$

Namely, 23 seconds are required for stapling after the finish of copying.

In contrast to the above, in the sorting system of the invention, when setting the first sorter and the second sorter to receive respectively 14 sets ($N_1=14$) and 6 sets ($N_2=6$) based on Table 1, and substituting these values in the expression (6), the time required for the first sorter $T_A$ and that for the second sorter $T_B$ coming from expression (7) are as follows.

$$\begin{aligned} T_A &= L_1/V + t_2 \times N_1 - t_1 \times (N_T - 1) \\ &= 2000/1000 + 2 \times 14 - 1 \times (20 - 1) \\ &= 11 \text{ (sec)} \end{aligned}$$

$$\begin{aligned} T_B &= L_2/V + t_2 \times N_2 - t_1 \times (N_2 - 1) \\ &= 10 \text{ (sec)} \end{aligned}$$

Therefore, it is possible to shorten the time required from the conventional 23 ($T_1$) seconds to 11 ($T_A$) seconds in the method of the invention mentioned above.

As described above, finishing time required after copying can be shortened and upper bins of each sorter only can be used mainly without necessity of using lower bins. Therefore, it is not necessary for users to stoop for taking out sheets from lower bins, which contributes to improvement for easy operation for the taking out of sheets.

Figure 6:
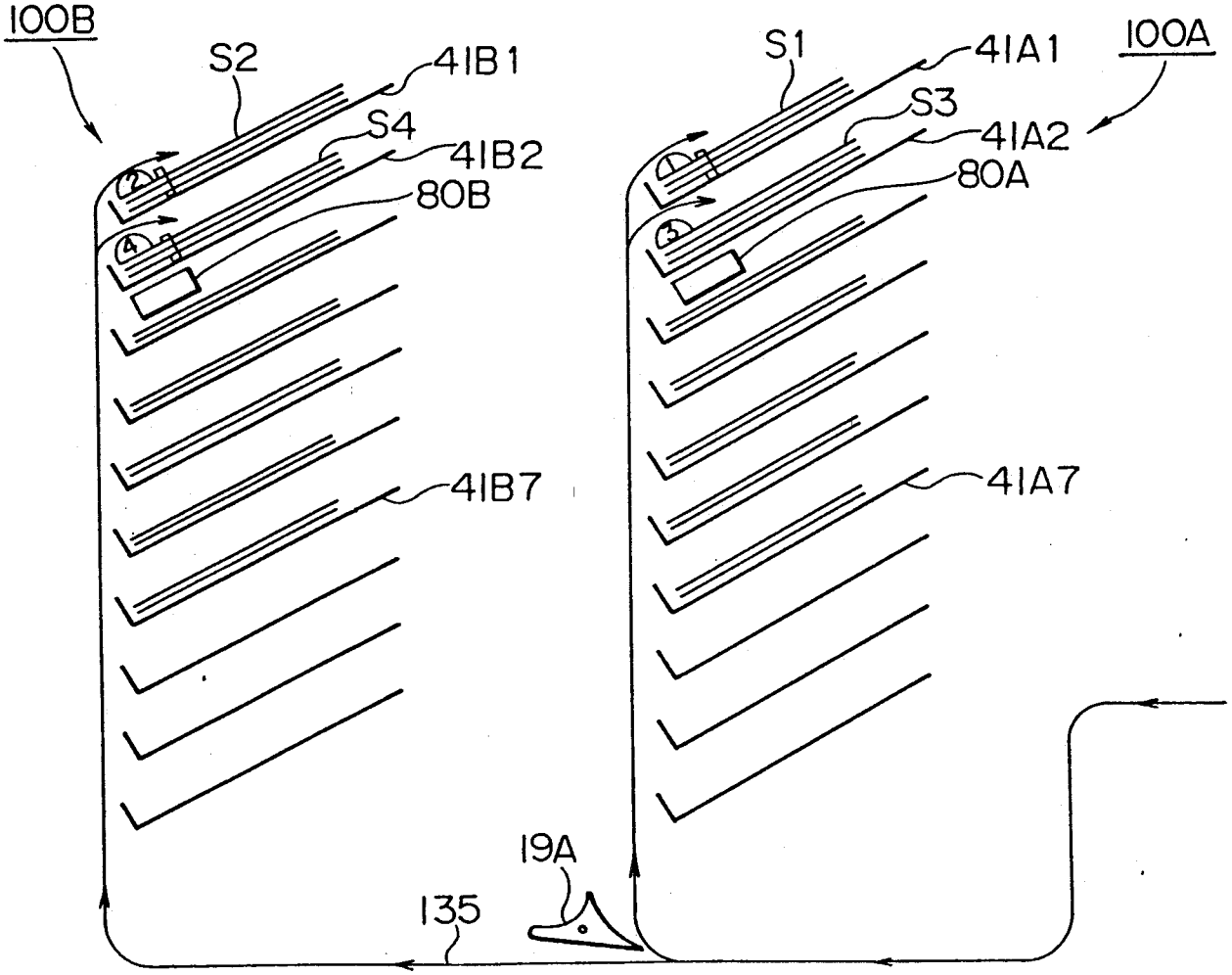
FIG. 6 is a schematic diagram illustrating the transport path for recorded sheets in the double-linked sorter equipped with a stapler unit of the invention.
Figure 7:
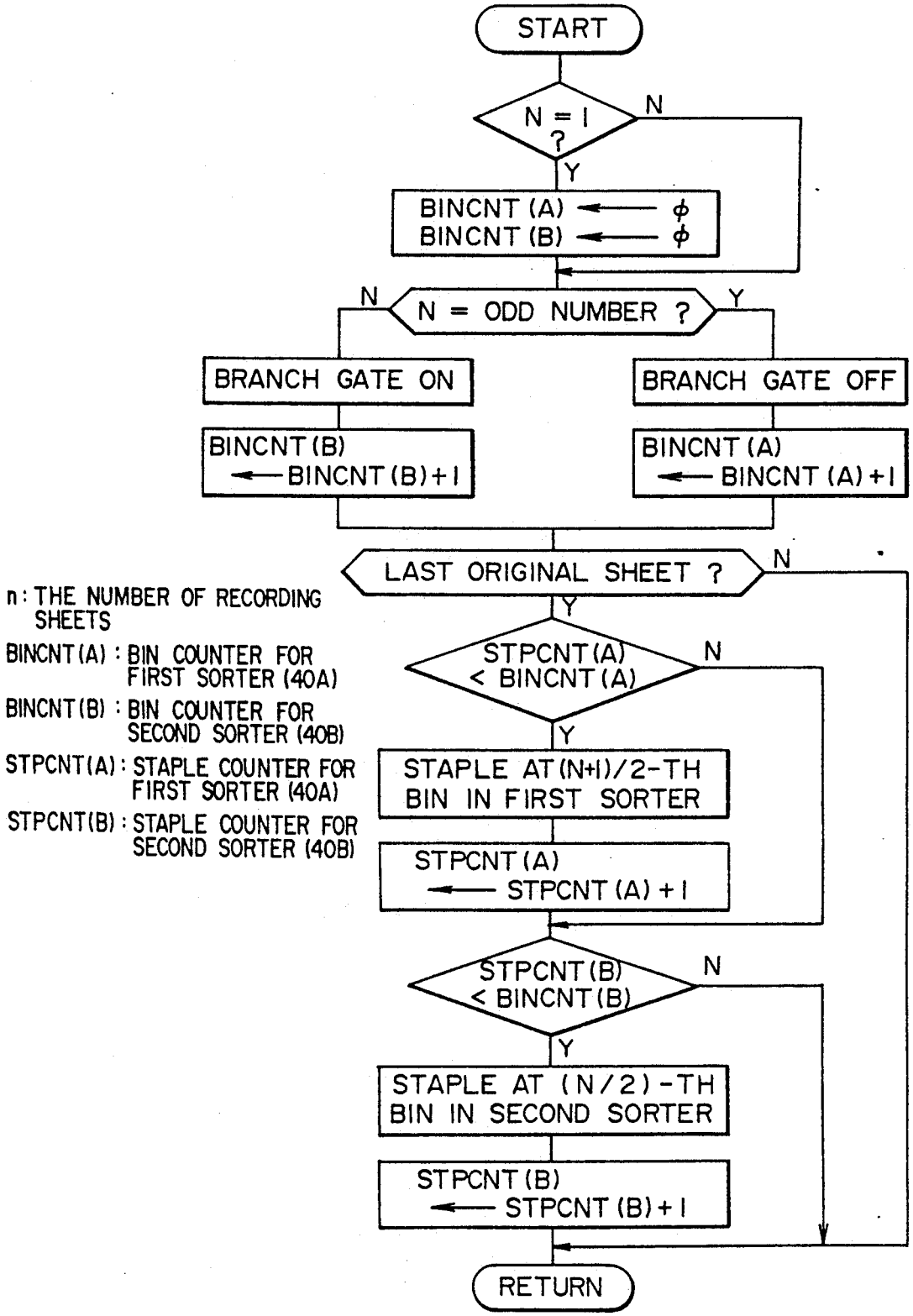
FIG. 7 is a flow chart showing the second example of the double-linked sorter equipped with a stapler unit of the invention.

The second example of a sorter provided with a stapler unit of the invention will be explained next. FIG. 6 is a schematic diagram showing a transport path through which a sheet is transported to a double-linked sorter provided with a stapler unit of the invention, and FIG. 7 is a flowchart illustrating the actions of the double-linked sorter.

(a) The first (odd number) sheet S 1 among a plurality of recorded sheets (n sheets) corresponding at least to the last original goes up along the upper surface of branch gate plate (branching gate) 19 and is led to the first sorter 100A to be received in the uppermost bin 41A 1, thus sorting for the first sheaf of sheets is completed.

(b) Sheet 52 that is a second (even number) sheet among at least the last copying is received in the uppermost bin 41B of the second sorter 100B due to switching of the branch gate plate 19A and thereby the sorting of the second sheaf of sheets is completed.

(c) During the period of sheet transporting to and sorting in the bin 41B 1 of the aforementioned second sorter 100B, stapler unit 80A moves to the sheaf of sheets (S 1) sorted on the bin 41A 1 of the first sorter 100A and staples them.

(d) Sheet S 3 that is a third sheet among at least the last copying is sent again to the first sorter 100A due to the switching of the aforementioned branch gate plate 19A, and then is placed on the sheaf of sheets in the bin 41A 2 on the second step for the subsequent sorting.

(e) During the period of the last sheet transporting to and sorting in the aforesaid bin 41A 2, stapler unit 80B moves to the sheaf of sheets including preceding sheet S 2 on the bin 41B 1 and staples them.

(f) Likewise, during the period of the last sheet (S 4) transporting to and sorting in the bin 41B 2 on the second step of the second sorter 100B, stapler unit 80A goes down from the bin 41A 1 to the bin 41A 2 and further moves to the sheaf of sheets (S 3) on the first sorter 100A for stapling them.

In the manner mentioned above, each time at least the last recorded sheet ejected from image forming apparatus main body 1 is sent in a double-linked sorter, branch gate plate 19A switches a sheet-transport path between sorter 100A and sorter 100B. Thereby, the recorded sheets are sent, on a one by one and alternate basis, to each of sorters 100A and 100B to be received therein. (41A 1→41B 1 →41A 2→41B 2→. . . →41A 7→41B 7). During a period wherein the last recorded sheet is transported to, received by and sorted in the bin of one sorter, a sheaf of sheets the sorting for which has been finished in the bin of the other sorter is stapled.

Therefore, simple control can cause recorded sheets sorted and received in both sorters to be stapled almost concurrently. Further, with regard to actions such as a fall, a movement, stapling and pushing in of each of stapler units 80A and 80B, they are carried out in the vicinity of a bin while recorded sheets are being transported to the other bin and paginated therein. Therefore, the operation speed of the stapler unit can be a half of the conventional speed, resulting in excellence in terms of reduction of driving force and vibration as well as stability.

Incidentally, though the last recorded sheets are sorted to both sorters to be received therein through allocation in the above explanation, it is also possible to allocate, from the beginning, on a one by one basis, the recorded sheets ejected from an image forming apparatus to both sorters.

As stated above, in a plurality of sorters capable of being connected to an image forming apparatus main body in the invention, when the bins of both sorters are allocated to be used effectively, the time required for finishing of imageprocessed sheets such as for sorting, grouping and stapling can be shortened, and thereby processed sheaves of sheets can be taken out quickly, resulting in reduction of downtime and improvement in easy operation for taking out of sheets.

What is claimed is:

1. A sorting apparatus of a linkage type for sorting a plurality of recorded sheets that are ejected one by one from an image recording apparatus, the sorting apparatus comprising:

at least two sorters located in order from a first sorter to a last sorter after the image recording apparatus, each sorter being provided with a plurality of bins and a stapling unit, wherein each bin being for storing a stack of recorded sheets sorted as a copy set and the stapling unit stapling each stack of the recorded sheets;

controlling means for allocating each recorded sheet to a bin of a sorter, which preselects a group of sorters according to the number of copy sets to be made and preselects a group of bins in each preselected sorter so that the allocation is performed to each bin of the preselected bin groups; and guide means for guiding the recorded sheet to a bin of the preselected bin groups according to the allocation by the controlling means, wherein the controlling means preselects at least two sorters when the number of the copy sets to be made is larger than a predetermined number, the predetermined number being less than the total number of the bins of the first sorter.

2. The apparatus of claim 1, wherein the controlling means preselects the first sorter and the second sorter when the number of the copy sets to be made is further not more than the total number of the copy sets to be made.

3. The apparatus of claim 1, wherein the control means preselect at least the first sorter and the second sorter when the number of the copy sets to be made is larger than the number of bins in the first sorter.

4. The apparatus of claim 1, wherein the control means preselects the sorters and the groups of bins so as to minimize a time difference between an earliest staple-end and a latest staple-end, the staple-end being an end of the stapling to all copy sets stored in each preselected sorter.

5. The apparatus of claim 1, wherein, at least in allocating a final recorded sheet of each copy set, the control means allocates each final recorded sheet to each preselected sorter in an order of the preselected sorters from a first preselected sorter to a last preselected sorter and repeats the same allocation until the end of storing for all the recorded sheets.

6. The apparatus of claim 5, wherein, at least in a stage to store an ultimate recorded sheet allocated last to each preselected sorter, the controlling means controls the storing of the recorded sheets and the stapling of the copy sets so that, while a stapler of a sorter is performing a stapling operation to a copy set, an ultimate recorded sheet which comes next is stored to a bin in a soter allocated next.

* * * * *